United States Patent [19]

Kuijk

[11] Patent Number: 4,990,905

[45] Date of Patent: Feb. 5, 1991

[54] METHOD OF DRIVING A DISPLAY DEVICE AND A DISPLAY DEVICE SUITABLE FOR SUCH METHOD

[75] Inventor: Karel E. Kuijk, Eindhoven, Netherlands

[73] Assignee: U.S. Philips Corp., New York, N.Y.

[21] Appl. No.: 277,403

[22] Filed: Nov. 28, 1988

Related U.S. Application Data

[63] Continuation of Ser. No. 67,652, Jun. 29, 1987, abandoned.

[30] Foreign Application Priority Data

Jul. 10, 1986 [NL] Netherlands ..... 8601804

[51] Int. Cl.[5] ..... G09G 3/36

[52] U.S. Cl. ..... 340/805; 340/784

[58] Field of Search ..... 340/718, 719, 765, 784, 340/793, 805; 350/331 R, 332, 333

[56] References Cited

U.S. PATENT DOCUMENTS

| | | | |
|---|---|---|---|
| 4,223,308 | 9/1980 | Baraff et al. | 340/784 |
| 4,404,555 | 9/1983 | Long et al. | 340/784 |
| 4,485,380 | 11/1984 | Soneda et al. | 340/784 |
| 4,600,274 | 7/1986 | Morozumi | 340/784 |
| 4,638,310 | 1/1987 | Hyliffe | 340/784 |
| 4,640,582 | 2/1987 | Oguchi et al. | 350/333 |
| 4,705,345 | 11/1987 | Hyliffe et al. | 340/784 |
| 4,714,921 | 12/1987 | Kanno et al. | 340/784 |
| 4,717,244 | 1/1988 | Hilsum et al. | 350/331 R |
| 4,779,085 | 10/1988 | Mizutome et al. | 340/805 |
| 4,803,480 | 2/1989 | Soneda et al. | 340/784 |
| 4,811,006 | 3/1989 | Kuijk | 340/719 |

OTHER PUBLICATIONS

"Liquid Crystal Matrix Displays", by B. J. Lechner et al., IEEE vol. 59, No. 11, Nov. 1971 pp. 1566–1579.

*Primary Examiner*—Jeffery A. Brier

*Attorney, Agent, or Firm*—Bernard Franzblau

[57] ABSTRACT

The number of grey levels in LCD display devices is drastically increased by not selecting the picture elements during a part of the line period and by providing them with data signals of opposite polarity. The capacitive crosstalk thereby decreases considerably. This provides the possibility of introducing more grey levels by sub-division of the picture elements into a number of sub-sections providing an extra drive with extra column electrodes. Alternatively, omission of the extra drive enables a given redundancy which would otherwise be impossible due to loss of grey levels.

18 Claims, 3 Drawing Sheets

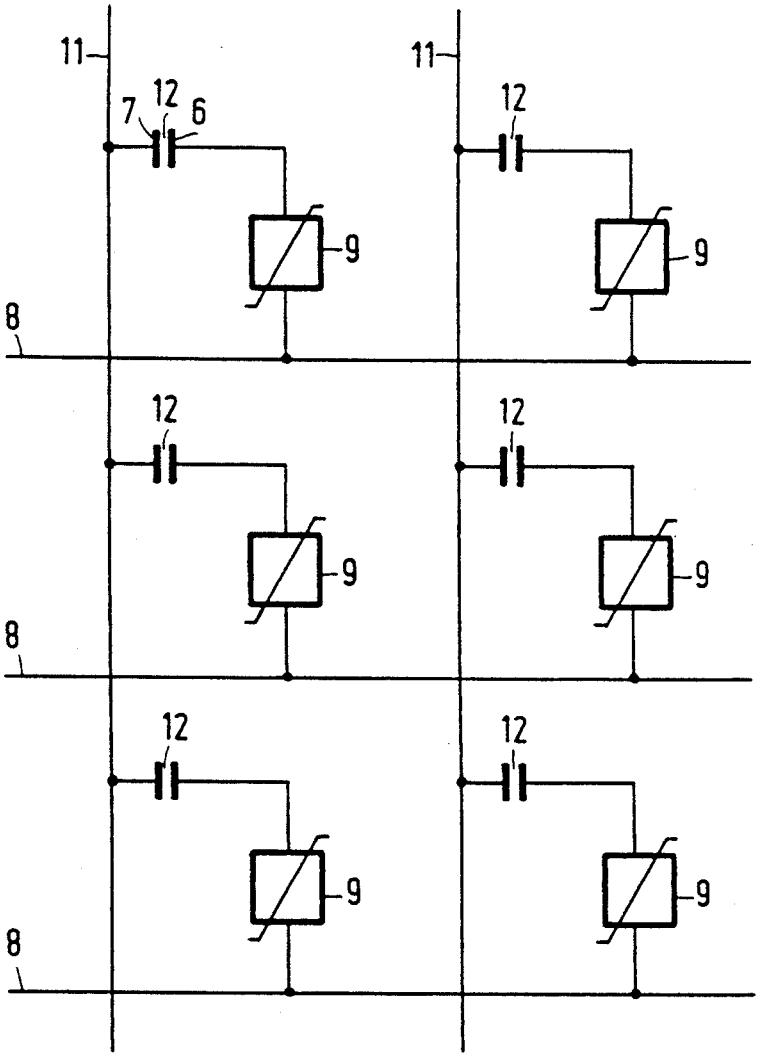
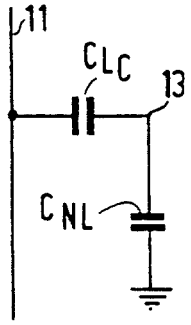
FIG. 4
FIG. 3
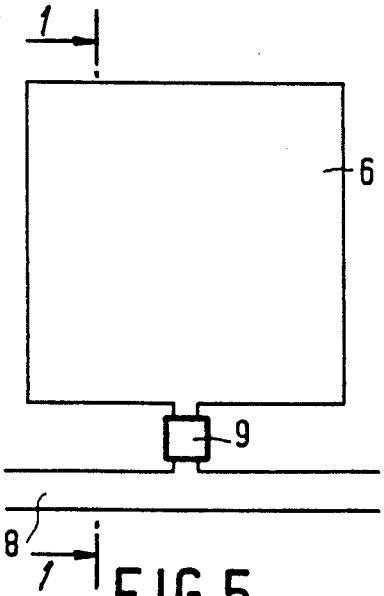
FIG. 5
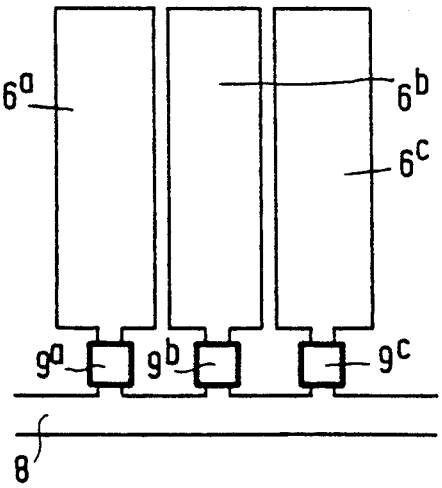
FIG. 6

METHOD OF DRIVING A DISPLAY DEVICE AND A DISPLAY DEVICE SUITABLE FOR SUCH METHOD

This is a continuation of application Ser. No. 067,652, filed June 29, 1987 now abandoned.

BACKGROUND OF THE INVENTION

The present invention relates to a method of driving a display device comprising an electro-optical display medium between two supporting plates, a system of picture elements arranged in rows and columns with each picture element being constituted by picture electrodes provided on the facing surfaces of the supporting plates and a system of row and column electrodes, a row of picture elements being selected during a selection period by applying a voltage thereto via the row electrodes by means of non-linear switching elements arranged in series with the picture elements while data signal is presented thereto via the column electrodes.

The invention also relates to a display device in which such a method can be used.

In this respect it is to be noted that the terms row electrode and column electrode in this application may be interchanged if desired, so that a column electrode can be meant where reference is made to a row electrod while simultaneously changing column electrode to row electrodes.

A display device of this type is suitable for displaying alpha-numeric and video information with the aid of passive electro-optical display media such as liquid crystals, electrophoretic suspensions and electrochrome materials.

A display device, as described, is shown in U.S. Pat. No. 4,223,308 in which back-to-back diodes are used as switching elements. By using switching elements a memory action is obtained so that the information presented to a driven row remains present across a picture element to a sufficient extent during the period when the other row electrodes are driven. However, due to capacitive cross-talk caused by the capacitance of the non-linear switching elements this information may have a varying value because the same columns are used for presenting data signals during selection of different rows of picture elements.

The voltage across a picture element may then vary in such a way that the transmission level shifts to a higher or lower degree of transmission (grey level). If the grey levels are to be fixed exclusively via the transmission curve, the number of grey levels is limited to a large extent due to the said crosstalk in relation to the maximum signal level.

The crosstalk due to signal variations is in the first instance dependent on the capacitance of the non-linear switching elements.

Another possibility of realizing grey levels is to subdivide a picture element into a number of subsections sub-sections determines the grey level. This requires an extra drive with extra column electrodes.

Such a sub-division without extra drive may also be used for the purpose of providing a given redundancy, because connections may drop out. This sub-division usually leads to smaller sub-elements for which smaller picture electrodes are used. However, this results in the capacitance of the picture elements decreasing (relatively) with respect to that of the non-linear switching elements. As a result the said crosstalk becomes larger.

SUMMARY OF THE INVENTION

It is an object of the present invention to provide a method of the type described in the opening paragraph in which the above-mentioned drawbacks are substantially obviated.

To this end a method according to the invention is characterized in that a data signal, after selection of a row and before selection of a subsequent row, changes its sign (polarity) with respect to a reference voltage determined by the average value of the minimum data voltage in a first field and the maximum data voltage in a second field and in that the energy content of the sub-signal having a positive sign (polarity) with respect to the reference voltage is substantially identical to that of the sub-signal having a negative sign (polarity) with respect to the reference voltage.

A value of 0 Volt is preferably chosen for the said reference voltage.

As it were, the crosstalk is compensated by generating a crosstalk signal of opposite sign (polarity) and with a substantially identical energy content.

This can only be achieved in practice with non-linear switching elements having an I-V characteristic which is symmetrical with respect to the origin or can be considered as such for practical use, such as for example back-to-back diodes, metal-insulator-metal switches (MIM) or semiconductor switches of the type nin, pip or circuits as proposed in the article "Liquid Crystal Matrix Displays" by B. J. Lechner et al, Proc. IEEE Vol. 59, no. 11, November 1971 pages 1566–1579, notably page 1572.

The data signal preferably consists of 2 sub-signals having substantially identical absolute voltage values and a direction of substantially half the selection time. The signals of opposite signs can then be obtained with simple inverter circuits.

Notably when rapid non-linear switching elements such as, for example, diode rings are used, switching can be effected at such a rate that selection times of 2–32 μsec, are used for line periods of 64 μsec (PAL system).

This renders the method attractive for use in color television having a double number of lines (high-definition TV).

Since the said crosstalk has now become substantially negligible, the picture elements can be split up into a plurality of sub-elements for the purpose of redundancy. A first device for using a method according to the invention, comprising an electro-optical display medium between two supporting plates, a system of picture elements arranged in rows and columns with each picture element being constituted by picture electrodes provided on the facing surfaces of the supporting plates and a system of row and column electrodes for driving the picture electrodes via non-linear switching elements, is therefore characterized in that a picture electrode is split up into a plurality of sub-electrodes which are each driven via at least one non-linear switching element.

A further display device of the type described is characterized in that a column electrode is connected to a connection point for a signal to be displayed via a parallel arrangement of two branches having complementary operating switches, one of the branches including an inverter circuit in series with the switch.

Complementary operating switches are understood to mean that one switch is opened while the other switch is closed and vice versa.

The display device also preferably comprises a control circuit for the complementary switches.

BRIEF DESCRIPTION OF THE DRAWINGS

The invention will now be described in greater detail with reference to some embodiments and the drawing in which:

FIG. 6 shows a modification of the display cell of FIG. 5, FIG. 7 diagrammatically shows signals as they occur if the device of FIG. 3 is operated in a conventional manner, FIG. 8 diagrammatically shows similar signals which occur when a method accordingto the invention is used, and FIG. 9 diagrammatically shows a circuit for realizing such signals.

DESCRIPTION OF THE DRAWINGS

Figure 1:
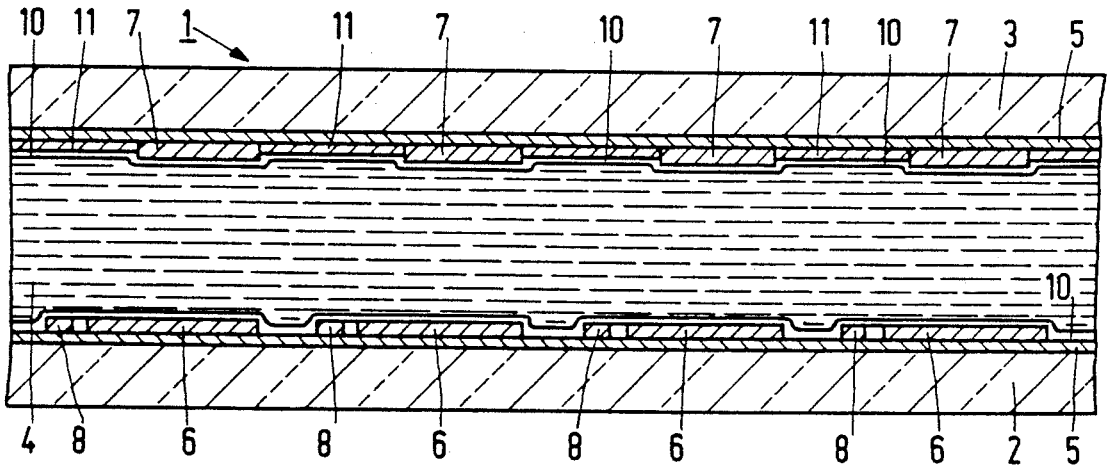
FIG. 1 diagrammatically above a cross-section of part of a display device in which the invention is used, FIG. 2 diagrammatically shows a transmission/voltage characteristic curve of a display cell in such a display device, FIG. 3 diagrammatically shows part of a control circuit for such a display device, FIG. 4 diagrammatically shows a substitution diagram of an element of such a display device, FIG. 5 diagrammatically shows a plan view of a display cell.

FIG. 1 diagrammatically shows a cross-section of part of a display device 1 which is provided with two supporting plates 2 and 3 between which a liquid crystal 4 is present. The inner surfaces of the supporting plates 2 and 3 are provided with electrically and chemically insulating layers 5. A large number of picture electrodes 6 and 7 arranged in rows and columns are provided on the supporting plates 2 and 3, respectively. The facing picture electrodes 6 and 7 constitute the picture elements of the display device. Strip-shaped column electrodes 11 are provided between the columns of picture electrodes 7. Advantageously, the column electrodes 11 and the picture electrodes 7 can be integrated to form strip-shaped electrodes. Strip-shaped row electrodes 8 are provided between the rows of picture electrodes 6. Each picture electrode 6 is connected, for example, to a row electrode 8 by means of a non-linear switching element not further shown in FIG. 1. The elements provide the liquid crystal 4, by means of voltages at the row electrodes 8, with a sufficient threshold with respect to the voltage applied to the column electrodes 11 and provide the liquid crystal 4 with a memory. Furthermore liquid crystal orientation layers 10 are provided on the inner surfaces of the supporting plates 2 and 3. As is known a different orientation state of the liquid crystal molecules and hence an optically different state can be obtained by applying a voltage across the liquid crystal layer 4. The display device can be realized both as a transmissive and as a reflective device, and may be provided with polarizers.

Figure 2:
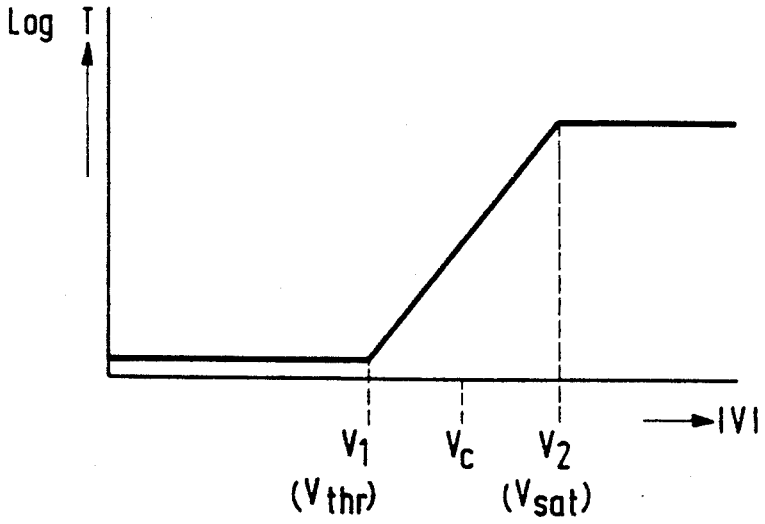

FIG. 2 diagrammatically shows a transmission/voltage characteristic curve of a display cell as occurs in the display device of FIG. 1. Below a given threshold ($V_1$ or $V_{thr}$) the cell transmits substantially no light, whereas above a given saturation voltage ($V_2$ or $V_{sat}$) the cell is substantially completely light-transmissive.

FIG. 3 diagrammatically shows a part of such a display device. The picture elements 12 are connected via the picture electrodes 7 to column electrodes 11 which together with the row electrodes 8 in this embodiment are arranged in the form of a matrix. The picture elements 12 are connected to the row electrodes 8 via non-linear switching elements 9.

FIG. 4 shows a substitution diagram for a picture element 12 represented by the capacitance $C_{LC}$ associated therewith and the associated non-linear switching element (in the high-ohmic state) $C_{NL}$ for calculating the crosstalk due to signal variations at a column electrode 11. The non-linear element which is connected to a fixed voltage i considered to be connected to ground for the description below (while using the superposition principle). This non-linear element may be back-to-back diodes but it may alternatively consist of diode rings, MIM-switches, pip's, nin's or other two-terminal devices while $C_{NL}$ may also be a connection of the picture electrode 6 via, for example, a plurality of diodes to different row electrodes as described, for example, in Netherlands Patent Application No. 8502663 corresponding to copending U.S. patent application Ser. No. 913,175 tiled Sept. 26, 1986, now U.S. Pat. No. 4,811,006 (3/7/89), the disclosure of which is incorporated herein by reference.

If a signal variation $\Delta V$ occurs at the column electrode 11 in, for example, a device for picture display (TV), this results at the point 13 in a signal variation $$\Delta V \cdot \frac{C_{NL}}{C_{LC} + C_{NL}}$$

The maximum signal variation at the column electrode or data line 11 occurs when it changes from $-V_{dmax}$ to $+V_{dmax}$ or conversely ($V_d$=data voltage) so that for the maximum variation $\Delta Vm$ at the point 13 $\Delta V_m$ it holds that:

$$\Delta V_m = 2\ V_{dmax} \frac{C_{NL}}{C_{LC} + C_{NL}}$$

In, for example, TV applications the data voltages in the even and odd field are considered to be of equal size but of opposite sign (polarity).

The value of this voltage variation must not lead to a grey level variation so that at N grey levels (i.e. a division of the horizontal axis in FIG. 2 between $V_{th}$ and $V_{sat}$ in N sections) and control around the point $\frac{1}{2}(V_{th}+V_{sat})$ it must hold that:

$$\frac{\Delta V_m}{2Vd_{max}} = \frac{C_{NL}}{C_{LC} + C_{NL}} \leqq \frac{1}{N} \quad (1)$$

For a typical liquid crystal picture element (sizes $300\times300\ \mu m^2$, thickness approximately 6 $\mu$m, $\epsilon_r \approx S$) and an a-Si nin switch (sizes approximately $10\times10\ \mu m^2$, thickness i-layer approximately 400 nanometer) it holds that $C_{LC} \approx 600$ fF and $C_{NL} \approx 30$ fF so that $N \geqq 21$. In the example of the said Patent Applications approximately the double value holds for $C_{NL}$ because a diode is provided on either side of the picture electrode. For this it holds that $N \geqq 11$.

If as stated above it is desirable to use redundance, one picture element can be split up into r sub-elements, each with their own driving element. This is diagrammatically shown in FIGS. 5 and 6 in which the picture electrode 6 with drive-switching element 9 (FIG. 5) is splitup into three sub-electrodes $6^a$, $6^b$, $6^c$ each with their own drive elements $9^a$, $9^b$, $9^c$ (FIG. 6). The picture electrode 7 corresponding to the picture electrode 6 is not splitup.

When splitting up the picture electrode into subelectrodes, the capacitance $C_{LC}$ also becomes smaller. It can be roughly assumed that in the first instance the number of grey levels decreases from N to $N'=N/r$ due to crosstalk when splitting up the picture element into r sections. In the two examples mentioned approximately 7 and approximately 4 levels thus remain available for the said split-up into 3 sub-electrodes (r=3). Particularly the latter level is generally too little for a satisfactory display. In the case of a still larger split-up of the picture electrode (still more redundancy) the situation becomes still less favourable.

As has been shown above, the maximum crosstalk in this example is $$V_1 = 2\,V_{dmax}\frac{C_{NL}}{C_{LC}+C_{NL}}$$

According to the invention a row is selected by applying the selection voltage $V_a$ during a part ($T_D$) of the selection period $T_s$ on the row electrode and by driving the column electrodes during this period with a data signal $V_D$, so that picture information is written in the picture elements; Subsequently the voltage at the row electrode is varied in such a way that the row is no longer selected (is connected to a value $V_{NS}$) and consequently the picture elements can no longer be written. Thereafter the columns are driven with a data signal $V'_D=-V_D$ of opposite sign during a period ($T_S-T_D$), with $T_S$ being at most equal to the available line period (64 μsec in the PAL system). In order to compensate for the crosstalk as completely as possible we choose:

$$V_D' = -V_D\frac{T_D}{T_S-T_D}$$

For the effective votlage value at a selected picture element with the desired voltage $V_{PO}$ it now holds that $$(V_{Peff})^2 = (V_{PO}+\Delta V_1)^2\frac{T_D}{T_S} + (V_{PO}+\Delta V_2)^2\frac{T_S-T_D}{T_S}$$

with $\Delta V_2 = -\Delta V_1\frac{T_D}{T_S}$ or $$V_{Peff} = V_{PO}\sqrt{1+\left(\frac{\Delta V_1}{V_{PO}}\right)^2\left[\frac{T_D}{T_S}+\frac{T_D^2}{(T_S-T_D)\,T_S}\right]}$$

This can be written approximately as $$V_{Peff} = V_{PO}\left[1+\tfrac{1}{2}\left(\frac{\Delta V_1}{V_{PO}}\right)^2\left\{\frac{T_D}{T_S}+\frac{T_D^2}{(T_S-T_D)\,T_S}\right\}\right]$$

Preferably we choose $T_D=\frac{1}{2}T_S$ and then it holds that $V'_D=-V_D$.

The data signal and the compensation signal are then of the same value from an absolute point of view so that the compensation signal can be obtained from the data signal in a simple manner by inversion.

Since $T_D$ is smaller than the selection period $T_S$, the switching element 9 is not conducting during the entire selection period which is, for example, 64 μsec in television applications. It is true the picture element is then not completely charged, but due to the steep characteristic of such elements this is negligible. In addition this loss of voltage is substantially identical for all switching elements so that, if desired, this can be compensated for in the selection voltages.

Figure 7:
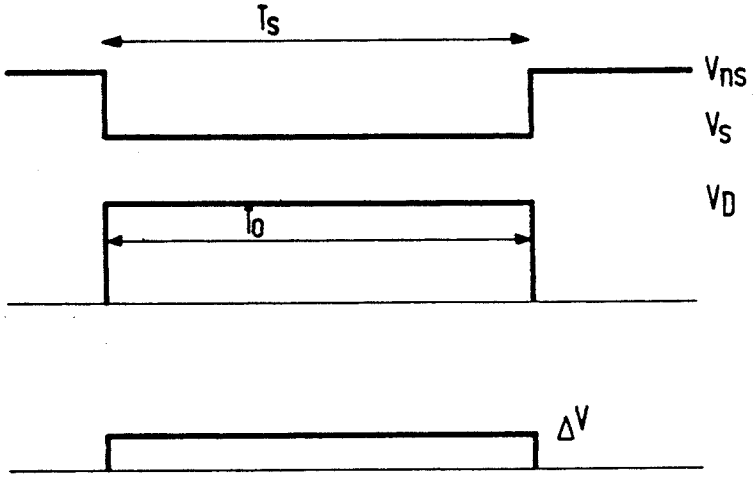
Figure 8:
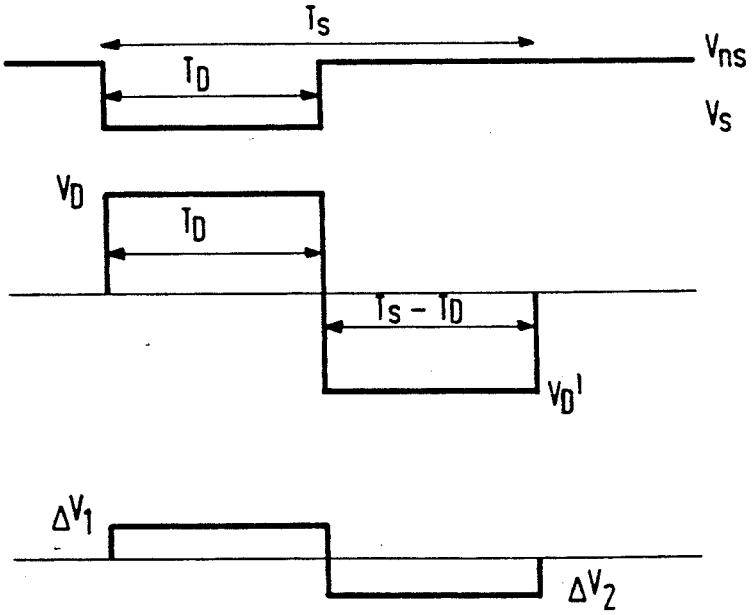

FIGS. 7 and 8 show the data $V_D$, $V'_D$ and the associated crosstalk signals $\Delta V$, $\Delta V_1$, $\Delta V_2$ for a device without and with the described crosstalk compensation.

The compensation signal $V'_D$ can be obtained in a simple manner from the signal $V_D$ which is presented, for example, to a common input port 14 (see FIG. 9) for a follower circuit 15 and an inverter 16 whose outputs are connected via complementary switches 17, 18 to a column electrode 11. By closing switch 17 during $T_D=\frac{1}{2}T_S$ and subsequently closing switch 18 during $\frac{1}{2}T_S$ by means of complementary signals supplied by a control circuit 20 to the switches 17 and 18, the desired signal is obtained at the column electrode.

For the drive mode as is used inter alia in the said Applications it holds that $$--V_{dmax}<V_d<V_{dmax} \text{ with } V_{dmax}=\tfrac{1}{2}(V_{sat}-V_{th}).$$

With equation (1) this leads to $$\frac{\Delta V'}{2V_{dmax}} = \frac{1}{2V_{PO}}\left(\frac{V_{sat}-V_{th}}{N^2}\right) \tag{5}$$

The term $$\frac{1}{2N^2}\;\frac{V_{sat}-V_{th}}{V_{PO}}$$

is maximum for $V_{PO}=V_{th}$ Substitution of $V_{PO}=V_{th}$ in (5) results in $$\frac{\Delta V'}{2V_{dmax}} = \frac{1}{2N^2}\left(\frac{V_{sat}-V_{th}}{V_{th}}\right)$$

This corresponds to $$2N^2/\left(\frac{V_{sat}}{V_{th}}-1\right)$$

grey level instead of N grey levels in the case without compensation. The numbe of grey levels thus increases by a factor of $$2N/\left(\frac{V_{sat}}{V_{th}}-1\right)$$

For a liquid crystal (ZLI 84460, Merck) it typically holds that $V_{th}=2.1$ Volt, $V_{sat}=3.6$ Volt, in other words, the number of grey levels increases by a factor of 2.8 N. For the shown split-up into 3 sub-electrodes the number of levels increases by a factor of 2.8 N from 4 to 7 to approximately 45 and 140, respectively.

The invention is of course not limited to the embodiment shown, but several variations are possible within the scope of the invention.

For example, for the non-linear switching elements, diode rings, back-to-back diodes, MIM switches, nin, pip or pinip switches can be chosen, provided that the switching rate is large enough.

Figure 9:
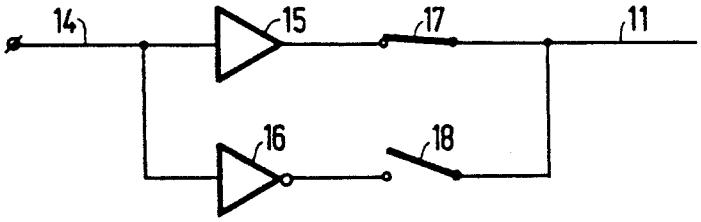

Several variations are also possible in the realization of the drive circuit of FIG. 9.

In addition different electro-optical media can be chosen such as, for example, electrophoretic suspensions or electrochrome materials.

The embodiment is based on a switching mode in which the data voltages switch around zero Volt and the voltage sweep 2 $V_{dmax}$ remained limited to $V_{sat}-V_{th}$. Also for other choices of the data voltage and the reference level the method according to the invention provides the said advantages. Possible deviations of the T–V curve from the exponential behavior can be compensated for in a single manner in practice by suitable choice of the data voltages which are allotted to given grey values.

What is claimed is:

1. A method of driving a display device which includes an electro-optical display medium between two supporting plates, a system of picture elements arranged in rows and columns with each picture element being constituted by picture electrodes provided on the facing surfaces of the supporting plates and a system of row and column electrodes, the method comprising, selecting a row of picture elements during a row selection period by applying a selection voltage thereto via the row electrodes by means of non-linear switching elements connected in series with the picture element and presenting a data signal thereto during said row selection period via the column electrodes, characterized in that the data signal, during a row selection period, changes its polarity with respect to a reference voltage determined by the average value of the minimum data voltage in a first period and the maximum data voltage in a second period such that the data signal comprises a sub-signal of positive polarity and a sub-signal of negative polarity wherein the energy content of the sub-signal having a positive polarity with respect to the reference voltage is substantially identical to that of the sub-signal having a negative polarity with respect to the reference voltage.

2. A method as claimed in claim 1, wherein the reference voltage is substantially 0 Volt.

3. A method as claimed in claim 2, wherein the data signal comprises two sub-signals having substantially identical absolute voltage values and a duration of substantially half the row-selection period.

4. A method as claimed in claim 3 wherein the duration of a sub-signal is between 2 and 32 μsec.

5. A method as claimed in claim 1, wherein the duration of a sub-signal is between 2 and 32 μsec.

6. A display device comprising, an electro-optical display medium between two supporting plates, a system of picture elements arranged in rows and columns with each picture element comprising picture electrodes provided on facing surfaces of the supporting plates, a series of row and a series of column electrodes for driving the picture electrodes via non-linear switching elements connected between said picture electrodes on one surface and one of the series of row and the series of column electrodes, and means for supplying to a column electrode, during a row selection period, a data signal which comprises first and second sub-signals of positive and negative polarity, respectively, relative to a reference voltage, and wherein the energy content of said first and second sub-signals is substantially equal.

7. A display device as claimed in claim 6, further comprising a control circuit for the complementary switches which controls said switches in a manner that either the data signal or a signal which is inverse to the data signal is applied to the column electrode.

8. A display device as claimed in claim 7, wherein the signals presented to the column electrodes are substantially equal in absolute value and are each presented during substantially half a section period of a row electrode.

9. A display device as claimed in claim 6, wherein the electro-optical medium is a liquid crystal, an electrophoretic suspension or an electrochrome material.

10. A display device as claimed in claim 6, wherein the electro-optical medium is a liquid crystal, an electrophoretic suspension or an electrochrome material.

11. A display device as claimed in claim 6 wherein a picture electrode is split up into a plurality of sub-electrodes which are each arranged to be driven via at least one non-linear switching element.

12. A display device as claimed in claim 11 wherein said data signal supplying means comprises a parallel arrangement including a first branch with a first switch and a second branch including an inverter circuit in series with a second switch operating complementary to the first switch, said device further including a control circuit for the complementary switches which controls said switches in a manner such that either the data signal to be displayed or a signal which is inverse to the data signal is applied to the column electrode.

13. A display device as claimed in claim 12 wherein the signals presented to the column electrodes are substantially equal in absolute value and are each presented during substantially half a selection period of a row electrode.

14. A display device according to claim 9 wherein the signals presented to the column electrodes are substantially equal in absolute value and of opposite polarity and are each represented during substantially half a selection period of a row electrode.

15. A display device according to claim 6 wherein the data signal supplying means supplies said first and second sub-signals to the column electrode in mutually exclusive time periods within said row selection period.

16. A display device as claimed in claim 6 wherein said data signal supplying means comprises a parallel arrangement including a first branch with a first switch and a second branch including an inverter circuit in series with a second switch operating complementary to the first switch, each switch being operated during the row selection period.

17. A method of driving a displaya device which includes an electro-optical display medium between two supporting plates, a system of picture elements arranged in rows and columns with each picture element being constituted by picture electrodes provided on the facing surfaces of the supporting plates and a system of row and column electrodes, comprising, selecting individual picture elements during respective selection periods by presenting selection signals to the row electrodes by means of non-linear switching elements arranged in series with the picture elements and presenting data signals to the column electrodes, in which method, after selection of a row and before selection of a subsequent row, the polarity of the data signal is changed with respect to a reference voltage so that the data signal comprises two sub-signals having equal absolute voltage values and durations shorter than a row-selection period.

18. A method as claimed in claim 17 wherein the durations of the two sub-signals are equal to each other and to the duration of a row selection signal which is half of the row selection period.

* * * * *